US007131544B1

(12) United States Patent
Cunningham

(10) Patent No.: US 7,131,544 B1
(45) Date of Patent: Nov. 7, 2006

(54) WALL CONFORMING WINE RACK FOR A PLURALITY OF BOTTLES

(75) Inventor: Daniel B. Cunningham, Lebanon, OH (US)

(73) Assignee: Long-Stanton Manufacturing Co., Inc., Hamilton, OH (US)

( * ) Notice: Subject to any disclaimer, the term of this patent is extended or adjusted under 35 U.S.C. 154(b) by 108 days.

(21) Appl. No.: 10/887,031

(22) Filed: Jul. 8, 2004

Related U.S. Application Data

(60) Provisional application No. 60/485,855, filed on Jul. 9, 2003.

(51) Int. Cl.
*A47B 73/00* (2006.01)

(52) U.S. Cl. ..... 211/74; 206/139

(58) Field of Classification Search ..... 211/79, 211/42, 43; 220/213, 509; 312/45, 120, 312/121, 123, 140, 201, 202, 300, 314–316; 52/245, 663, 581; 403/171
See application file for complete search history.

(56) References Cited

U.S. PATENT DOCUMENTS

| | | | | | |
|---|---|---|---|---|---|
| 923,721 | A | * | 6/1909 | Smith | 108/92 |
| 954,805 | A | * | 4/1910 | Hitchcock | 312/9.7 |
| 2,461,684 | A | * | 2/1949 | Dierickx | 312/204 |
| D160,123 | S | * | 9/1950 | Reinheimer et al. | D6/441 |
| 2,597,290 | A | * | 5/1952 | Childers | 312/45 |
| 3,746,178 | A | | 7/1973 | Wagschal | |
| D228,858 | S | | 10/1973 | Wagschal | |
| 3,784,021 | A | * | 1/1974 | Mark | 211/43 |
| D230,242 | S | | 2/1974 | Bentley | |
| D236,411 | S | | 8/1975 | Horney | |
| D251,049 | S | | 2/1979 | Gardner | |
| 4,252,488 | A | * | 2/1981 | Kochanneck | 414/331.03 |
| 4,270,662 | A | | 6/1981 | Gonzalez | |
| 4,422,555 | A | | 12/1983 | Jacobs | |
| D272,699 | S | | 2/1984 | Godfrey | |
| D275,059 | S | * | 8/1984 | Hoeffler | D8/395 |
| 4,550,539 | A | | 11/1985 | Foster | |
| 4,567,989 | A | | 2/1986 | Hurst, Jr. | |
| D292,657 | S | | 11/1987 | Wightman | |
| D313,711 | S | | 1/1991 | Levine | |
| 5,590,493 | A | * | 1/1997 | Wilson | 52/108 |
| D423,250 | S | * | 4/2000 | Wolff | D6/441 |
| 6,209,735 | B1 | | 4/2001 | Gladstone et al. | |
| 6,435,355 | B1 | * | 8/2002 | Brown | 211/44 |
| 6,688,057 | B1 | * | 2/2004 | Suzuki et al. | 52/245 |
| 6,918,640 | B1 | * | 7/2005 | DeMars | 312/140.2 |
| 2004/0049999 | A1 | * | 3/2004 | Krieger | 52/245 |
| 2004/0069730 | A1 | * | 4/2004 | Woods | 211/74 |
| 2004/0187403 | A1 | * | 9/2004 | Hauck | 52/80.1 |
| 2005/0103674 | A1 | * | 5/2005 | Matheou | 206/503 |

* cited by examiner

*Primary Examiner*—Richard E. Chilcot, Jr.
*Assistant Examiner*—Jared W. Newton
(74) *Attorney, Agent, or Firm*—Charles R. Wilson

(57) ABSTRACT

A wine rack for holding a plurality of bottles is configured to follow the contour of a curvilinear structural wall, whether convex or concave. The wine rack has a frame for holding open-ended elongated compartments. The compartments are loosely attached together at their respective first ends. Unattached second ends of the wine bottle compartments are free to flex laterally such that their ends generally follow the contour of the curvilinear structural wall.

13 Claims, 7 Drawing Sheets

WALL CONFORMING WINE RACK FOR A PLURALITY OF BOTTLES

This application claims the benefit of U.S. Provisional Application No. 60/485,855, filed Jul. 9, 2003.

FIELD OF THE INVENTION

This invention relates to a wine rack for holding a plurality of 5 bottles. More particularly, the invention relates to a wine rack having a plurality of wine bottle compartments which conform to a curvilinear wall.

BACKGROUND OF THE INVENTION

Racks for holding bottles of wine have been used for centuries. They can be as simple as a frame with horizontal shelves spaced apart sufficiently to hold bottles lying on their sides. Dividers are generally used to keep the bottles from contacting one another, thus reducing breakage. The dividers tend to be rigid slats or other structures designed to fit into the frame. They often are permanently attached. The dividers typically are positioned to create a set of individual compartments, each sized to hold one wine bottle lying on its side. Further, each compartment is uniformly configured to extend straight backwards. Wine racks tend to be box-shaped with a flat back wall. The typical wine rack, whether for commercial use or residential use, is designed to fit flush with a straight wall or with another box-shaped wine rack. Residential wine racks tend to be more aesthetically pleasing to the eye with a polished steel construction or perhaps a varnished wood construction. Regardless, all are designed to fit along a straight wall.

More modern architectural building styles allow walls which are curved, either convexly or concavely. A curvilinear wall may be only a few feet long such as in an entryway. It may also be several feet long to create a more dramatic appearing room for entertaining purposes. As can be readily imagined, a conventional box-shaped wine rack with its straight back side when placed along a curvilinear wall looks very out of place. This is especially true for a very long wall with a pronounced curvature. Forming a wine rack with a curved back side would create a structure which is more aesthetically pleasing, but would leave a problem of how to redesign dividers or compartments for the wine bottles. The uniform configuration of wine compartments with their substantially parallel walls simply cannot neatly fit into a curved frame.

It is apparent that while designing a frame with curved back and front sides to conform to a curvilinear wall is feasible, more is needed. The time is ripe for a wine rack which can be positioned to set flush with a curvilinear wall and hold a plurality of wine bottles in an orderly manner. Necessarily, the wine rack's overall appearance must appear sturdy as well as attractive.

In accord with a need, I have developed a wine rack which is made to conform to a curvilinear wall. The wine rack holds a plurality of bottles, e.g. well over 1,000 bottles if desired. The wine rack of the invention is aesthetically pleasing as well as sturdy enough to hold the plurality of bottles in a manner where each individual bottle can be conveniently removed as needed. It can, if desired, have the inherent ability to inhibit and suppress the growth of microbes.

SUMMARY OF THE INVENTION

A wine rack for holding a plurality of bottles is designed to be placed along curvilinear structural wall. The wine rack has a frame with at least a back side shaped to follow the wall. The frame holds a plurality of elongated open-ended wine bottle compartments. Each wine bottle compartment is configured to hold a wine bottle while resting on its side. The compartments have a first end and a second end. Each compartment is loosely attached to adjacent compartments near their respective first ends and unattached at their respective second ends. The compartments, confined by the frame, are able to flex outwardly from adjacent compartments at their unattached second ends while their first ends remain together. The flexing allows the unattached ends of the compartments to create generally a curve which conforms to the wall's curve.

DETAILED DESCRIPTION OF THE INVENTION

The wine rack of the invention is described below and with reference to the drawings. Its primary intended use is for the temporary storage of wine bottles, particularly those with a capacity of about 75 ml. liquid. It should be understood the wine rack is capable of holding other sized wine bottles and other elongated objects, such uses being contemplated. The wine rack 10 shown in FIG. 1 comprises three identical bottle sections 11–13 positioned side-by-side. In total, the wine rack has a 456 bottle capacity. It extends about eight feet along a curvilinear wall to follow the curve of that wall. The sections can be free-standing and placed side-by-side or secured together on site to collectively form the wine rack.

Figure 1:
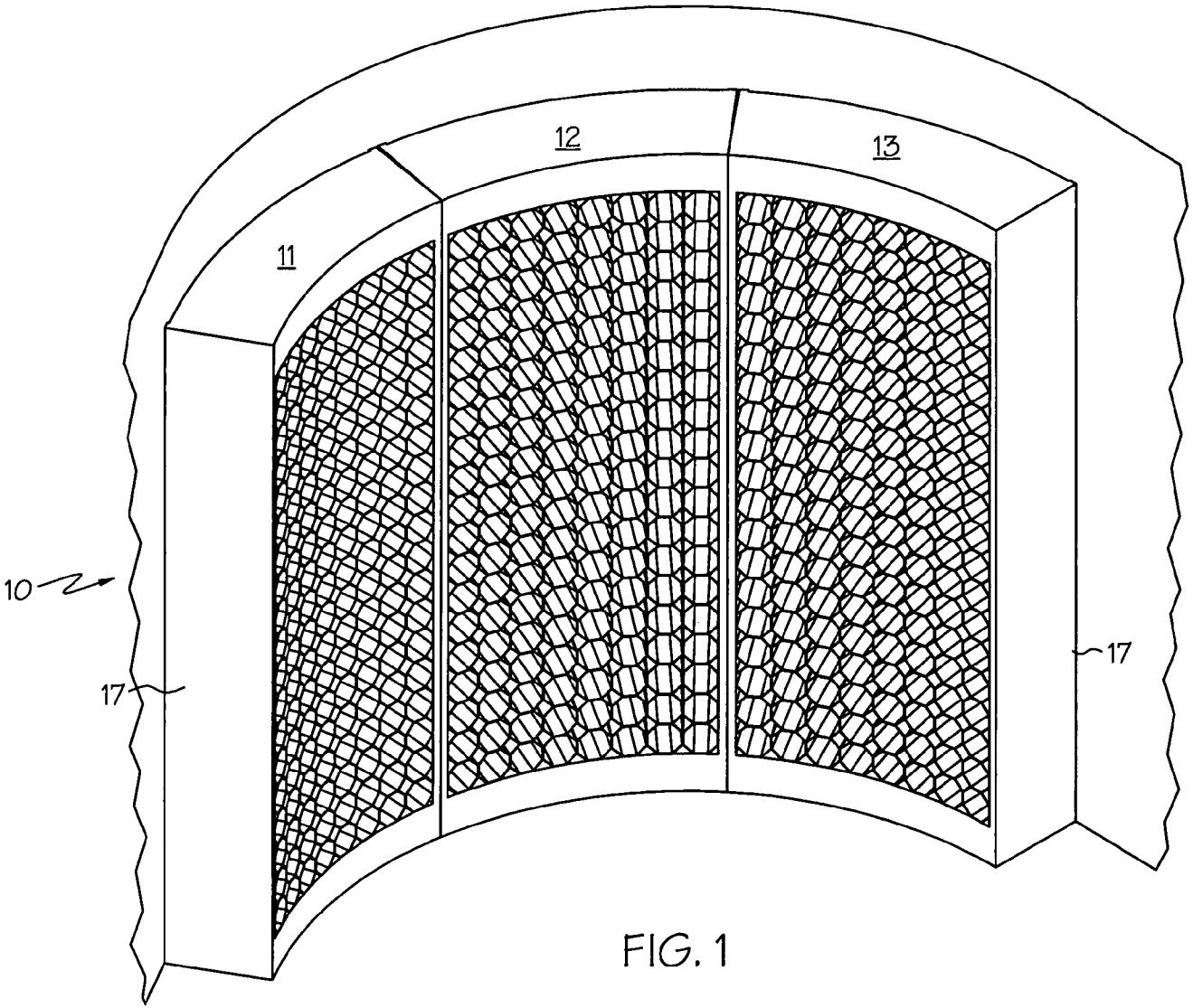
FIG. 1 is a perspective view of a wine rack of the invention placed along a curvilinear structural wall.

The wine rack depicted in FIG. 1 is designed to present a striking appearance in an upscale home. It can be designed for a more modest use. A length as small as about one foot is feasible. It can as well have an even larger capacity for a dramatic effect as might be found in a restaurant. A length of from about four feet to about twenty feet is practical, though it can be virtually any length and bottle capacity dictated only by the building's limitations.

The height of the wine rack of the invention is not limited, but for ease of convenience is typically from about three feet to about six feet in height. The frame is generally shallow in depth, sufficiently deep enough only to hold the wine bottles with no back or front bottle overhang. Typically from about twelve inches to about eighteen inches in depth is adequate.

Figure 2:
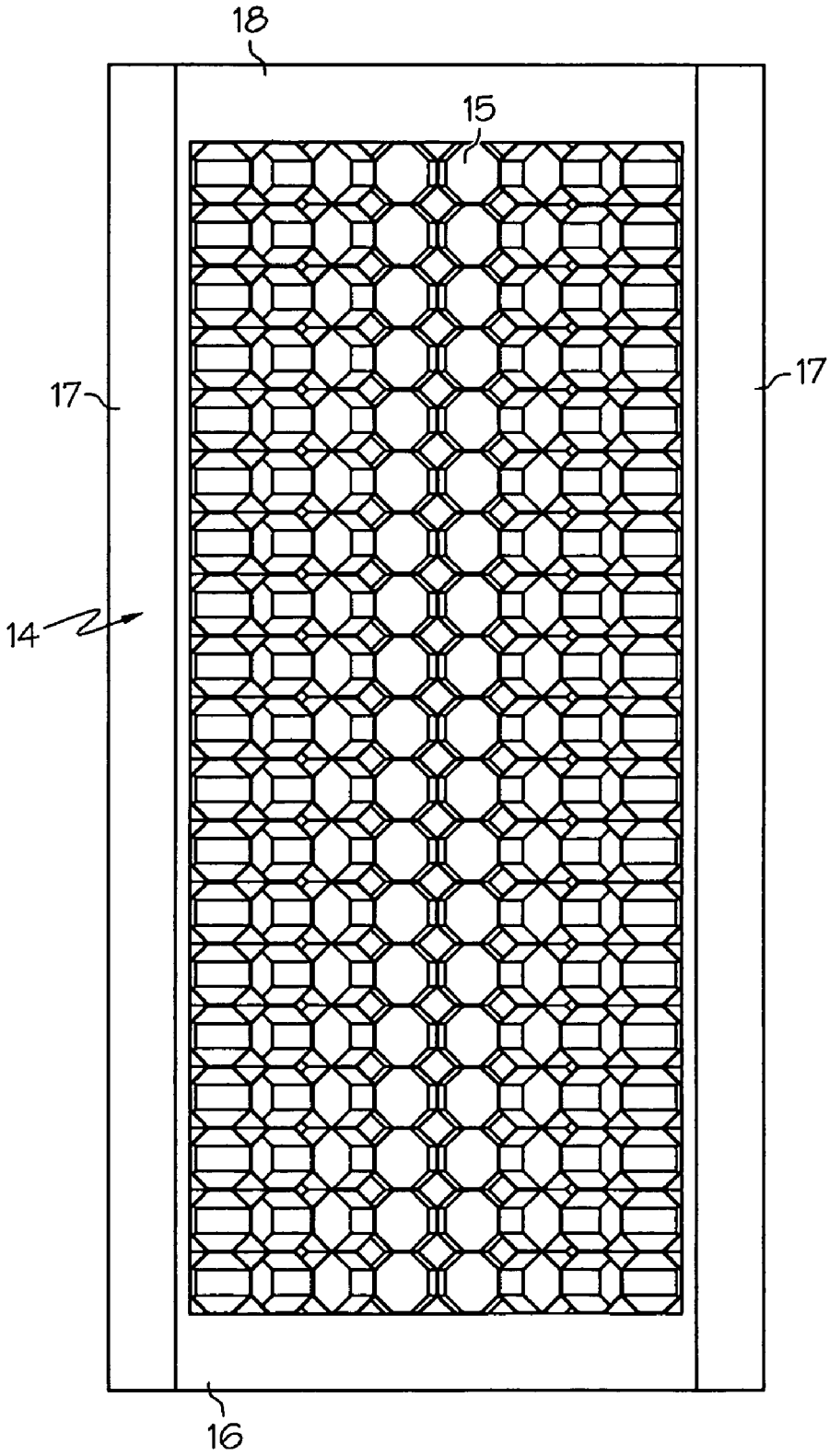
FIG. 2 is a front view in elevation of one section of the wine rack of FIG. 1 showing individual wine bottle compartments.

Now with reference to FIG. 2, each bottle section of the wine rack 10 has a frame 14 for containing the several bottle compartments 15 juxtaposed to one another. The frame 14 is made of a rigid material, e.g. steel. It has a horizontally extending bottom frame member 16. Vertically extending side frame members 17 extend at substantial right angles from both ends of the bottom frame member 16. A top frame member 18 extending horizontally to connect the side frame members 17 enhances the wine rack's stability.

Frame members 17, as best seen in FIG. 1, are solid panels which secure to the bottom and top frame members 16 and 18, respectively, to create a section of the wine rack 10. The frame members 16 and 18 are shaped to the needed curvature by a bending, cutting, or molding operation as dictated by the material of construction. The wine rack 10 is made and assembled in the factory if its length is conducive to conventional shipping methods. The individual sections can also be shipped and assembled on site to form the wine rack.

It should be apparent from FIG. 1, that the frame 14 is built so that its back side has the same degree of curvature as that of the structural wall. The degree of curvature for the frame can range from slight to pronounced, as found with a circular wall. The front side of the rack preferably has a degree of curvature substantially the same as its back side and the structural wall.

Added frame members, such as cross bars, are used to enhance stability of the wine rack if desired. The several frame members are joined together to form a rigid stable structure for containing the wine bottle compartments described next.

The plurality of wine bottle compartments 15 for use in the frame 14 are each designed to hold a wine bottle in a horizontally disposed position. Each is an elongated open-ended compartment with a length of from about ten inches to about fifteen inches and a major cross-dimension of from about three inches to about six inches. As evident from FIGS. 2–4, each compartment is octagonal-shaped when viewed in a cross-section taken normal to the direction of elongation of the compartment. One end must be open to receive a wine bottle. The opposed end can also be open or optionally can be closed off by a wall or some other bottle movement limiting means, e.g. a cross strap.

Figure 6:
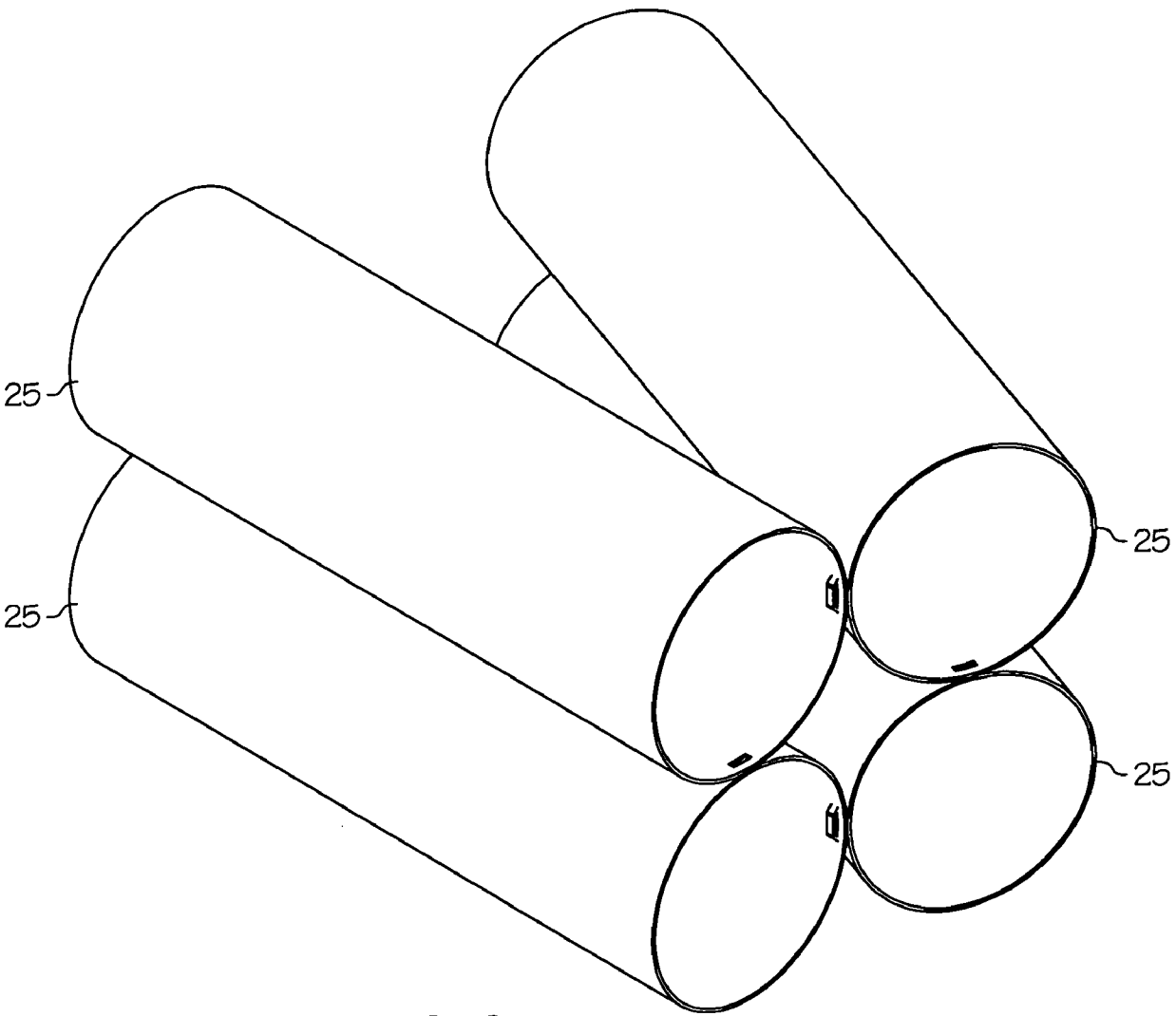
FIG. 6 is a perspective view of four wine bottle compartments each having a circular cross-section which can be used in the wine rack of the invention.

The compartments can have any desired cross-section shape, including without limitation square, diamond, hexagonal and circular. FIG. 6 illustrates a circular-shaped compartment and is described further below.

Figure 3:
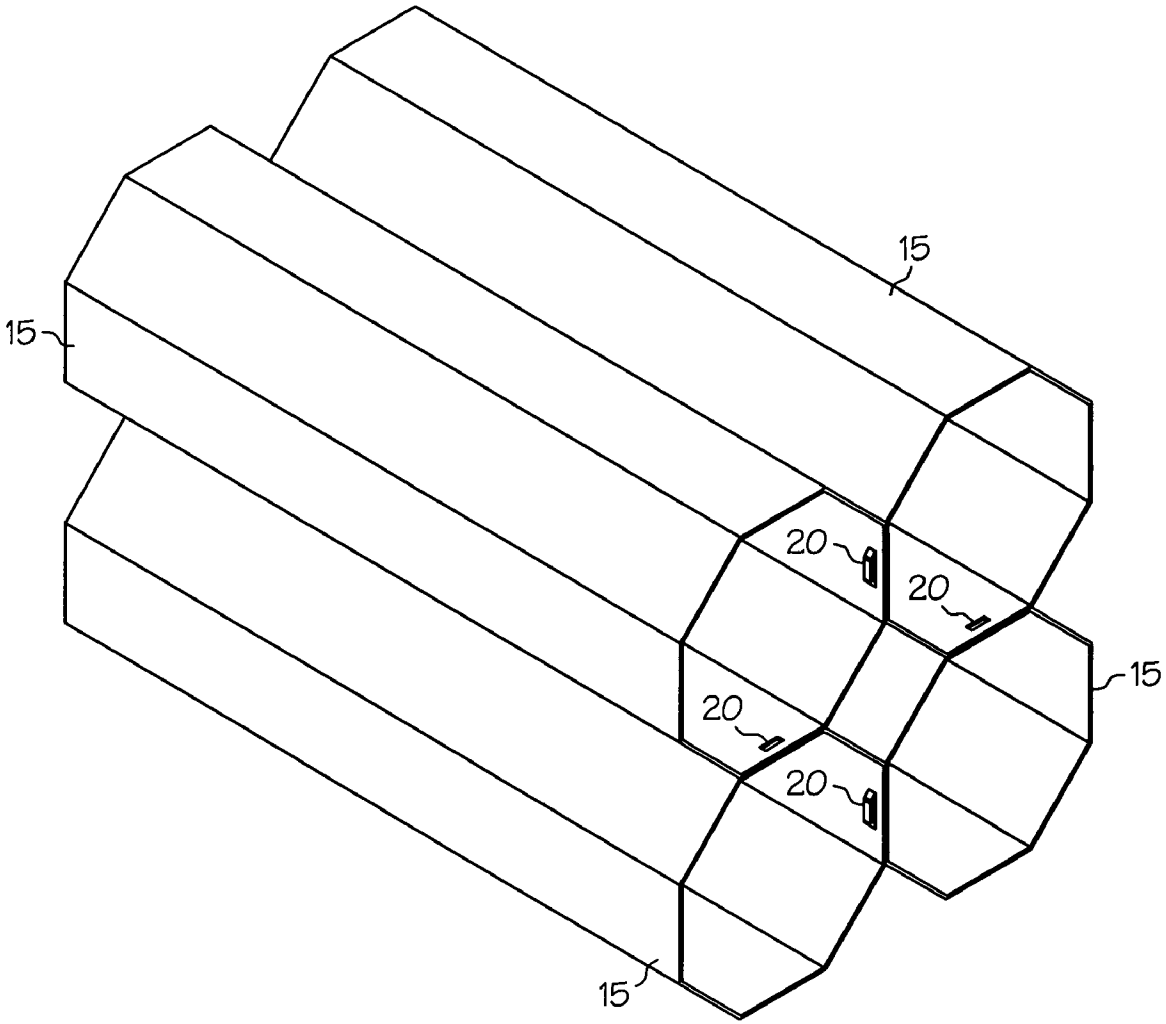
FIG. 3 is a perspective view of four of the wine bottle compartments of the wine rack of FIG. 1 in isolation to show their normal orientation relative to one another.
Figure 4:
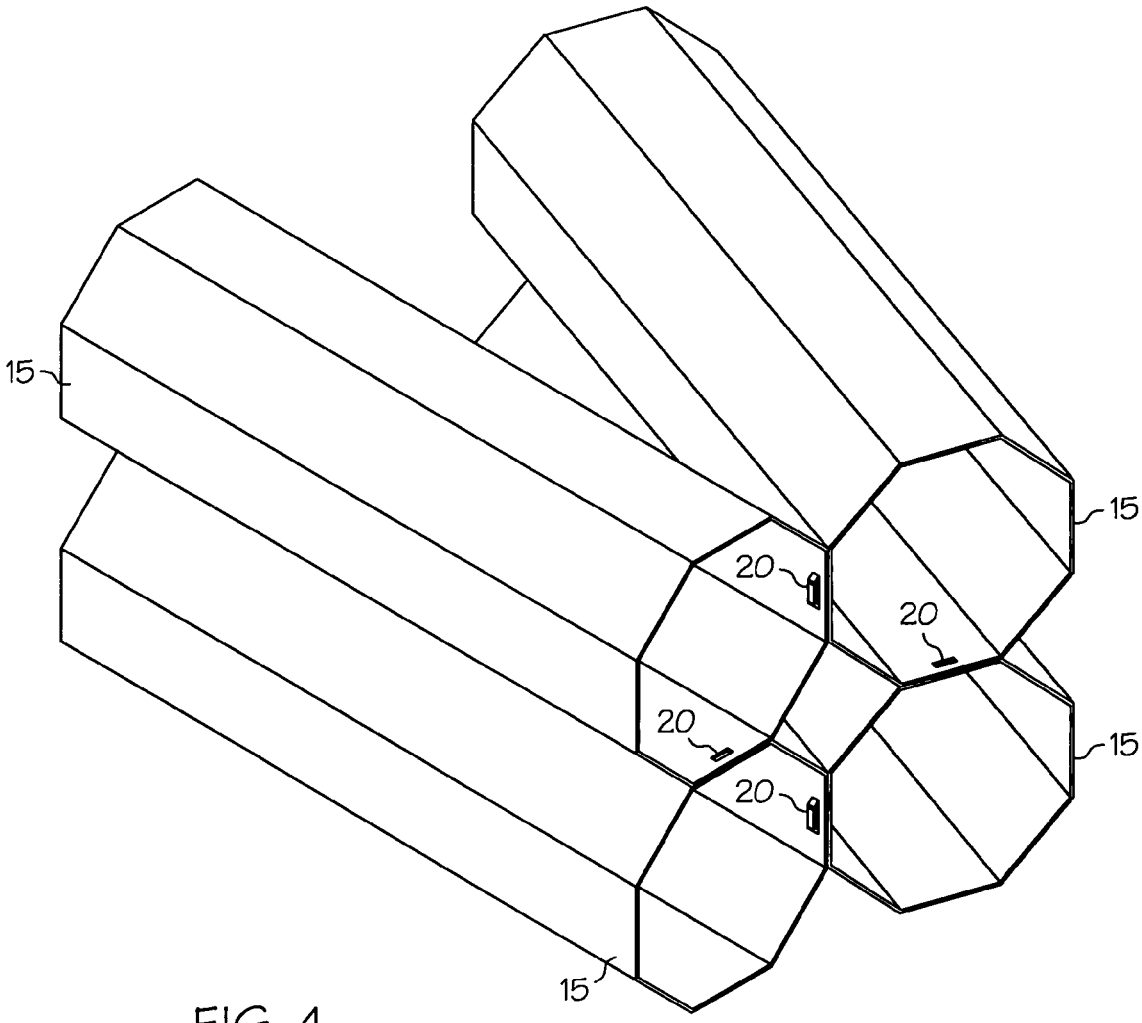
FIG. 4 is a perspective view of the four wine bottle compartments of FIG. 3 showing their unattached ends flexed outwardly to create a generally curved front edge.

In accord with this invention and as best seen in FIGS. 3 and 4, each wine bottle compartment is loosely attached near a first end to adjacent compartments by attachment means 20. The loose attachment allows the unattached ends to move laterally away from one another. Most importantly, the attachment means creates a hinging effect in the compartments. FIGS. 3 and 4 show four compartments isolated from the wine rack of FIG. 1. The ability of the compartments to flex laterally, i.e. outwardly from one another at their second end openings while remaining attached at their first ends is evident. As readily imagined, several adjacent compartments in the wine rack can be flexed laterally. Faces formed by terminuses of the open-ended compartments collectively form a generally curved surface. The faces of the full set of compartments in the wine rack generally follows the contour of the curved wall.

Figure 5:
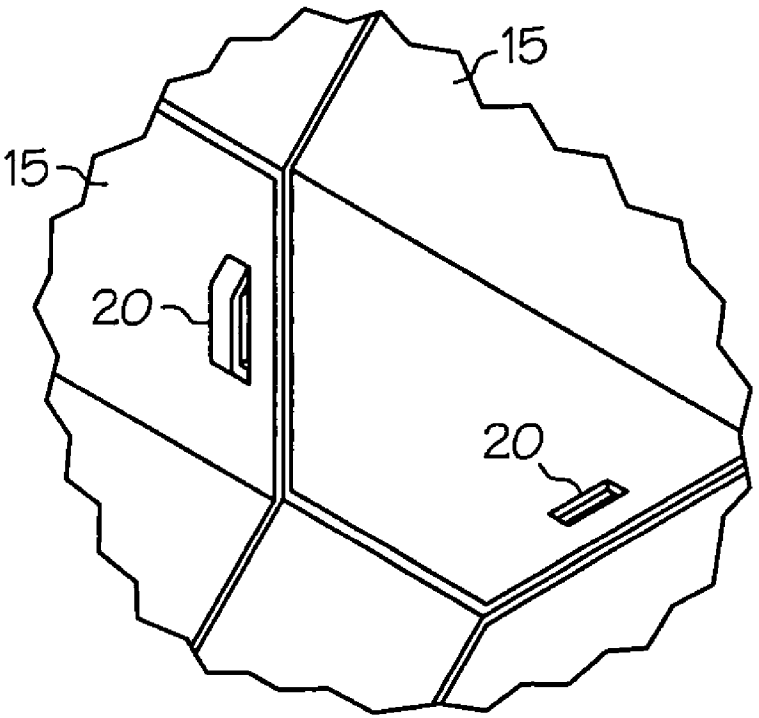
FIG. 5 is a view in isolation showing a mechanical stitch used to attach the individual wine bottle compartments of the wine rack of FIG. 1 loosely together.

Each of the internal compartments has four adjoining compartments and therefore each has four attachment means. A highly preferred attachment means is a mechanical stitching. As best seen in FIG. 5, the mechanical stitchings are positioned at common contact areas of adjoining compartments and at or near first end edges, i.e. within about two inches of the first end opening edges of the compartments. The closer the stitching to the end, the greater the individual compartments can flex outwardly. Preferably, the stitching is within about one inch of the compartments' first ends.

The mechanical stitchings are well known in the metal stamping industry. Other attachments of a nature which allow the compartment flexing can be used. Examples include rivets, screws, spot welds, clamps and bolts/nuts.

The number of bottle compartments, extending both laterally and vertically, to fill the frame is readily calculated. The compartments attached together as a whole are placed into the frame. They can be intermittently secured to any of the frame members of the frame to prevent movement, though need not be.

The wine bottle compartments are preferably made of an anti-microbial stainless steel to inhibit the growth of microbes on the wine rack for obvious reasons. Such steel is commercially available. Other materials having sufficient rigidity for the purpose intended can be used. Steel, aluminum, plastic and wood are examples of suitable materials.

Now with reference to FIG. 6, there is shown four open-ended elongated compartments mechanically stitched together near their respective first ends. Each of the compartments 25 has a circular-shape when viewed in a cross-section taken normal to its direction of elongation. The compartments are readily suited for substitution of the octagonal-shaped compartments 15 found in the wine rack 10 of FIG. 1.

Figure 7:
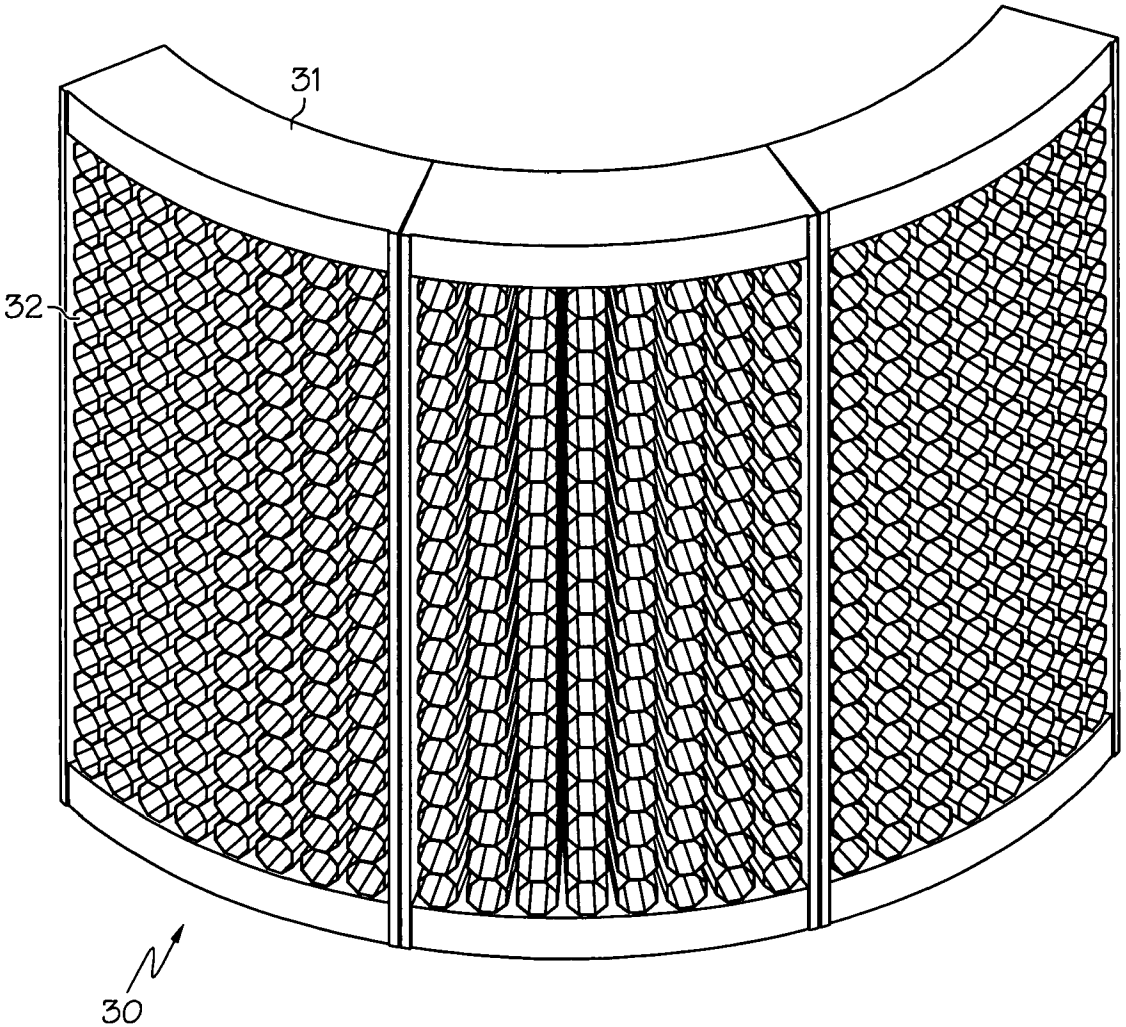
FIG. 7 is a top side view of another wine rack of the invention showing its placement along a curvilinear structural wall having a convex curve.

FIG. 7 depicts a wine rack 30 which is suited for placing along a curvilinear wall having a convex curve. A frame 31 is similar in construction to the frame 14 of the wine rack 10. The elongated open-ended compartments 32 are identical in shape and size as those described above. They are loosely attached together at their first ends, which is this embodiment of the invention are adjacent the structural wall. That is, the unattached second ends are flexed laterally so that faces formed by terminuses of the individual compartments create a generally convex curve.

In use, my wine rack is positioned along a desired curvilinear wall. The compartments' first ends with the mechanical stitchings are either distal the curved wall or proximal the curvilinear wall depending on whether there is a concave or convex wall. The bottle compartments are manually flexed laterally or "opened" to create a curvature which conforms to the curve of the wall. Both ends necessarily follow the contour of the curved wall. Once positioned, the wine rack is loaded with wine bottles and used in a typical manner.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A wine rack for holding a plurality of bottles in a substantially horizontal reclined position and for conforming to a curved structural wall, said wine rack comprising:

(a) a frame having a curved shape for following the curved structural wall and for containing a plurality of wine bottle compartments; and (b) a plurality of wine bottle compartments positioned in the frame to extend laterally therein and to extend vertically therein, wherein each said bottle compartment is an elongated open-ended compartment configured to hold a wine bottle while resting on its side with a first end and a second end, further wherein each said bottle compartment is hingedly attached to adjoining laterally disposed bottle compartments and hingedly attached to adjoining vertically disposed bottle compartments near their respective first ends and unattached at their respective second ends, whereby faces formed by terminuses of the wine bottle compartments collectively follow the curved shape of the frame.

2. The wine rack of claim 1 wherein the frame is from about four feet to about twenty feet in length.

3. The wine rack of claim 2 wherein adjoining wine bottle compartments are mechanically stitched near their respective first ends to one another.

4. The wine rack of claim 3 wherein each wine bottle compartment has a length of from about ten inches to about fifteen inches and a major cross-dimension of from about three inches to about six inches.

5. The wine rack of claim 4 wherein each wine bottle compartment is hingedly attached to adjoining wine bottle compartments within about two inches of their respective first ends.

6. The wine rack of claim 5 wherein each wine bottle compartment is hingedly attached to adjoining wine bottle compartments within about one inch of their respective first ends.

7. The wine rack of claim 1 wherein the frame is about three feet to about six feet in height.

8. The wine rack of claim 1 wherein the frame is about twelve inches to about eighteen inches in depth.

9. The wine rack of claim 1 wherein the frame is concave-shaped for following a concave-shaped structural wall.

10. The wine rack of claim 1 wherein the frame is convex-shaped for following a convex-shaped structural wall.

11. The wine rack of claim 1 wherein each wine bottle compartment is an octagonal shape when viewed in a cross-section taken normal to the direction of elongation of the wine bottle compartment.

12. The wine rack of claim 1 wherein each wine bottle compartment is made of an anti-microbial stainless steel to inhibit the growth of microbes on the wine rack.

13. A wine rack for holding a plurality of bottles in a substantially horizontal reclined position and for conforming to a curved structural wall, said wine rack comprising:

(a) a frame about four feet to about twenty feet in length, about three feet to about six feet in height and having a curved shape for following the curved structural wall and for containing a plurality of wine bottle compartments; and (b) a plurality of wine bottle compartments positioned in the frame to substantially fill said frame, wherein each said bottle compartment is an elongated open-ended compartment about ten inches to about fifteen inches in length and configured to hold a wine bottle while resting on its side with a first end and a second end, further wherein each said bottle compartment is mechanically stitched hingedly to laterally adjoining and vertically adjoining bottle compartments near within about one inch of their respective first ends and unattached at their respective second ends for flexing laterally, whereby faces formed by terminuses of the wine bottle compartments collectively follow the curved shape of the frame; and wherein the frame has a horizontally extending bottom frame member, side frame members extending vertically at substantial right angles from ends of the bottom frame member and connected thereto, and a top frame member extending horizontally from the side frame members and connected thereto and further the bottle compartments are positioned in the frame to extend from the bottom frame member to the top frame member and from one said side frame member to the other side frame member.

* * * * *